United States Patent [19]

Shires

[11] 4,274,266

[45] Jun. 23, 1981

[54] WATER COOLING SYSTEM FOR AIR COOLED AIR CONDITIONERS

[76] Inventor: Donald Shires, 1214 Normandy Dr., Miami Beach, Fla. 33141

[21] Appl. No.: 39,112

[22] Filed: May 15, 1979

[51] Int. Cl.[3] ..... F28D 3/00; B05B 15/06

[52] U.S. Cl. ..... 62/171; 62/305; 239/280; 261/69 R

[58] Field of Search ..... 62/305, 183, 171; 261/69 R, 66, DIG. 15, 111, 98; 137/499; 239/280, 597, 124

[56] References Cited

U.S. PATENT DOCUMENTS

| | | | |
|---|---|---|---|
| 2,076,600 | 4/1937 | Smith | 137/499 X |
| 2,278,242 | 3/1942 | Chapman | 62/305 X |
| 2,600,554 | 6/1952 | Lyons | 239/124 |
| 2,754,228 | 7/1956 | Bede | 239/124 X |
| 2,814,526 | 11/1957 | Blair | 239/280 X |
| 3,804,388 | 4/1974 | Jamell | 261/DIG. 15 |
| 4,028,906 | 6/1977 | Gingold et al. | 62/305 X |

*Primary Examiner*—William E. Wayner

*Attorney, Agent, or Firm*—John Cyril Malloy

[57] ABSTRACT

A system for directing a water spray onto the condenser unit of an air-cooled air conditioner in response to the operation of an air actuated valve when the air conditioner is energized; the air actuated valve is disposed in the exhaust air stream of the motor driven fan which normally creates a cooling air flow through the condenser unit of the air conditioner. The air actuated valve directs a stream of water from a line connected to a controlled pressurized water source to a water manifold provided with a plurality of branch conduits, fitted with spray nozzles, positioned to direct a water spray onto the condenser coils.

13 Claims, 9 Drawing Figures

WATER COOLING SYSTEM FOR AIR COOLED AIR CONDITIONERS

BACKGROUND OF THE PRESENT INVENTION

The present invention pertains to an air-cooled air conditioning apparatus of the general type utilized in residential homes, apartments and commercial structures, and converts the air-colled air conditioning system into a combination air and water cooled system.

An air actuated paddle valve assembly reacts to the exhaust air flow stream from an existing motor driven fan, when the unit is energized. The fan normally directs a cooling flow of air over the condenser coils and the paddle valve opens a water conduit means connected between a controlled pressurized water source and a water manifold attached to the air conditioner in a position to direct a plurality of relatively fine water sprays over the condenser coils to augment the cooling effect of the air stream.

Therefore, one of the principal objects of the invention is to provide for the general public, who utilize air cooled air conditioning systems, a means to convert their existing air cooled system into a more highly efficient combination air and water cooled system which will reduce the electrical power consumption of the systems while in operation.

A further object of the invention is, in addition to reducing the electrical power consumption, to reduce the operating cost and increase the cooling efficiency of the system while prolonging the life thereof by reducing the overall operating time to cool a given area to a desired degree.

Another object of the invention is to provide a non-electrical device which is very simple to attach to an air conditioner and can be so attached by the general public with no danger of electrical shock and which requires no tools or special technical skills.

Yet another object of the invention is to provide a water cooling system for an air-cooled air conditioning system which is adaptable to virtually all types of air-cooled air conditioning systems and which is completely attached to the exterior thereof, eliminating any need to enter into or alter the existing system.

Another object of the invention is to provide a water cooling device of the above described type which utilizes a very low water pressure and is attachable to any standard water faucet or garden hose thereby eliminating the need of special plumbing installations or ruptured water lines because of the low water pressure requirements.

DESCRIPTION OF A PREFERRED EMBODIMENT

Figure 1:
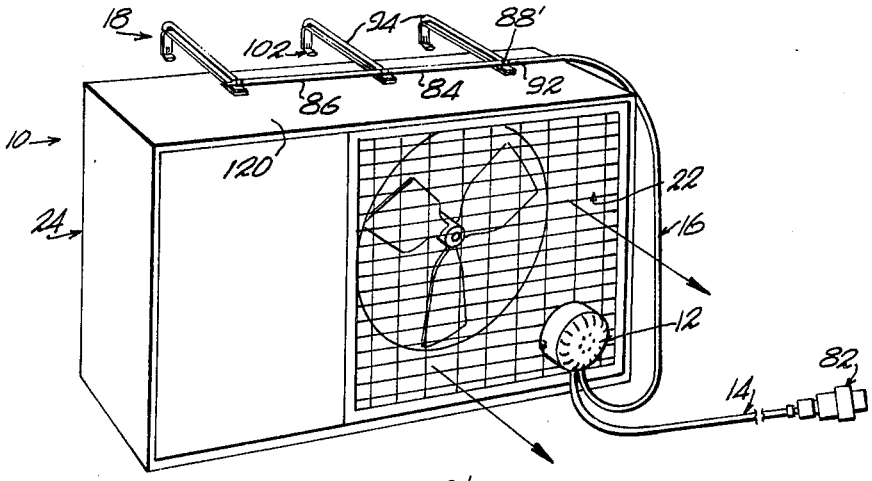
FIG. 1 is a perspective view of a typical air-cooled air conditioning unit with the water cooling device of the present invention attached thereto.

With reference to the drawings in which like reference characters designate like or corresponding parts throughout the various views, and with particular reference to FIG. 1, a typical air-cooled air conditioning unit, designated generally at 10, is equipped with the water cooling device of the present invention comprising generally, an air operated paddle valve assembly 12, with a first water conduit means 14, for attachment therefrom to a source of pressurized water, and a second water conduit means 16 connected from valve assembly 12 to a water spray manifold assembly 18.

Figure 3:
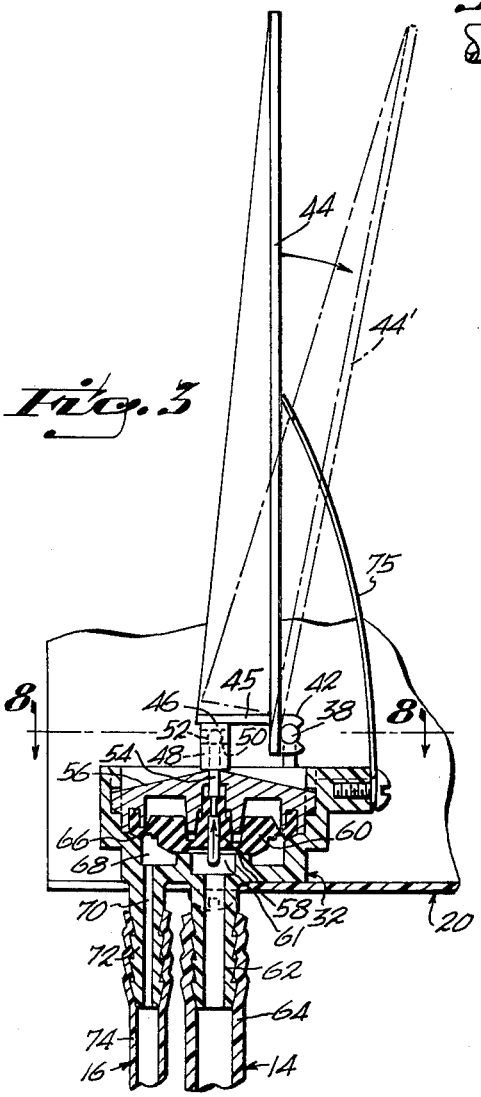
FIG. 3 is an enlarged vertical sectional view taken through the air paddle valve assembly attached to the exterior of the grill as seen in FIGS. 1 and 2.

With particular reference to FIGS. 1 and 3, the air operated paddle valve assembly 12 is mounted in a housing 20 fixed exteriorly to a grill 22, conventionally fixed in the air conditioner housing 24 in the path of the exhausted air stream, indicated by arrows 26, created by a motor driven fan 28 conventionally utilized in air-cooled air conditioner units such as 10 to cool the condenser coils 30 in the air stream path 26.

Figure 8:
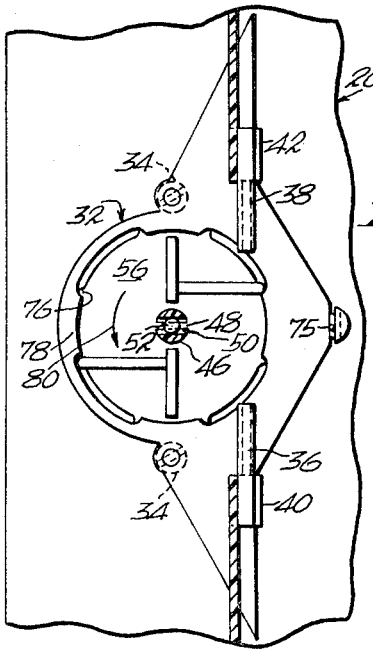
FIG. 8 is a sectional view taken along line 8—8 of FIG. 3.

As seen in FIG. 8, a valve housing 32 is fixed as at 34 within housing 20 and includes a pair of spaced apart, axially aligned pivot pins 36, 38 for snap-in engagement in respective clips 40, 42 carried along the bottom edge of the wind paddle 44. As seen in FIG. 3, a lateral inward projection 45 from the bottom portion of paddle 44 includes a downwardly projecting stud 46, slotted at 48 with a rounded transverse top portion 50, FIGS. 3 and 8, for reception of a spherical top end 52 of a valve pin 54. Pin 54 is axially slidable through a valve cap 56 and includes a lower end portion 58 securely embedded in a resilient water valve member 60, normally in a closed relation with a water port 61, including a nipple 62 for friction engagement by the end portion 64 of first water conduit 14.

Water valve member 60 is peripherally captivated between cap 56 and a shoulder 66 of housing 32. When paddle 44 is air operated to the position indicated at 44', the fixed engagement of valve pin 54 in valve member 60 causes said member 60 to open relative to port 61 to permit a flow of water into chamber 68 of valve housing 32 and through a discharge port 70 in a second nipple 72, securely fitted with an end portion 74 of second water conduit means 16, connected to water manifold assembly 18. Paddle 44 is spring-loaded as at 75 to a valve closing position.

Valve cap 56 is peripherally provided with a plurality of flanges 76 which are positioned and sized to engage under a like plurality of housing flanges 78 when said cap 56 is rotated as indicated by arrow 80. The extended end of first water conduit 14 is provided with a generally conventional type of pressure regulator valve 82 for engagement on any conventional faucet or water hose coupling. The pressure control valve is designed to deliver a constant flow of water at ten P.S.I., for example.

Figure 4:
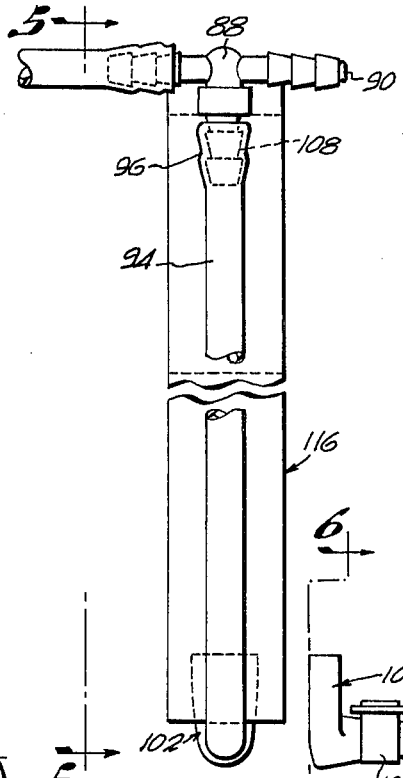
FIG. 4 is an enlarged top plan view of one of the water manifold spray heads and connecting tubes disposed atop the unit in FIGS. 1 and 2.

The water manifold assembly 18 is comprised of a plurality of hose lengths, two illustrated at 84, 86, interconnected by conventional triple nipple fittings 88, FIG. 4. The open end of the end fitting 88 may be plugged as at 90, or a single nipple may be used at the end. End portion 92 of second water conduit means 16 is engaged on first triple nipple fitting 88', FIG. 1. Each triple nipple fitting 88 carries a spray tube 94, FIGS. 1, 4 and 5, at a generally ninety degree angle to the manifold assembly 18.

With particular reference to FIGS. 4 through 7, each spray tube 94 is fixed at a first end 96 to a triple nipple fitting 88 and at a second end 98 to a nipple portion 100 of a spray head 102. A pair of slip-on clips 104, 106, engaged respectively on spray head nipple 100 and a nipple 108 of triple nipple fitting 88, are appropriately slotted on both sides as at 110, 112 to engage respective side eges of slots 114, one shown in FIG. 7, formed in both ends of a semi-flexible mounting strip 116. In the form illustrated in the drawings, the mounting strips are right angular to accommodate the air conditioner illustrated in FIGS. 1 and 2, however, they are readily formable to accommodate any individual installation.

Figure 2:
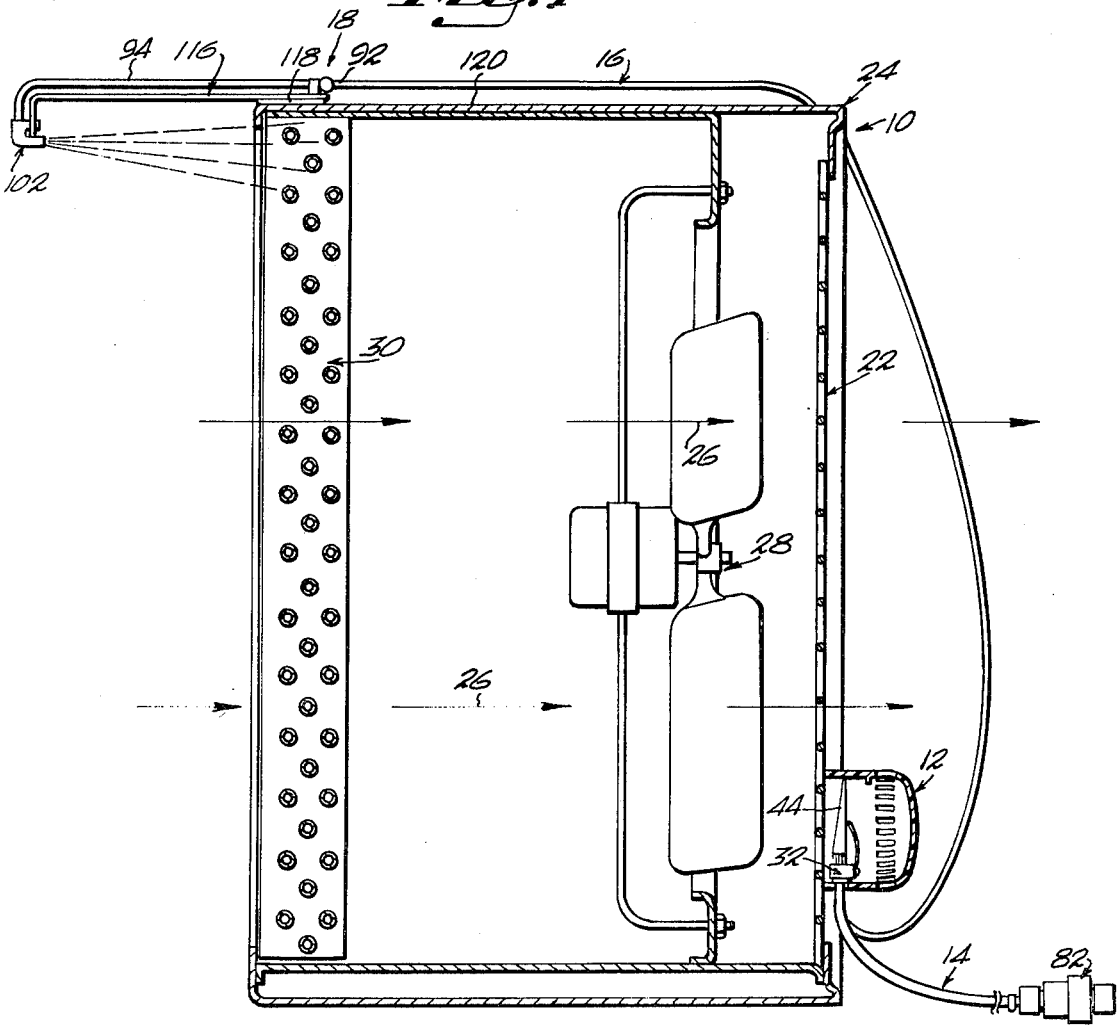
FIG. 2 is a vertical sectional view taken through the unit of FIG. 1, generally along a line through the motor driven fan and condenser unit therein.
Figure 5:
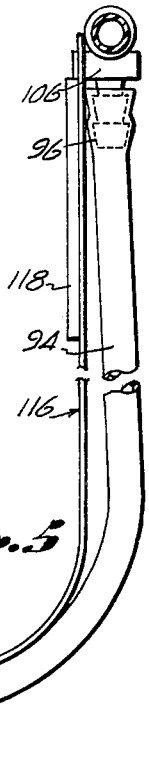
FIG. 5 is a sectional view, taken along line 5—5 of FIG. 4.

Referring to FIGS. 2 and 5, a length of double sided pressure sensitive adhesive tape 118 is secured to the underside of the manifold end of each mounting strip 116 for secure fixed engagement with the top side 120 of the air conditioner housing 24 in a position to direct a spray of water onto the condenser coils, FIG. 2, from spray head 102.

Figure 6:
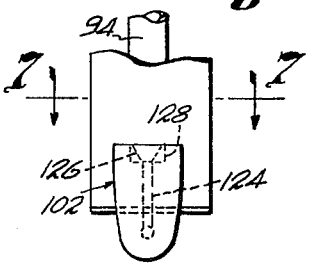
FIG. 6 is a fragmentary view of the spray head as seen along line 6—6 of FIG. 5.
Figure 7:
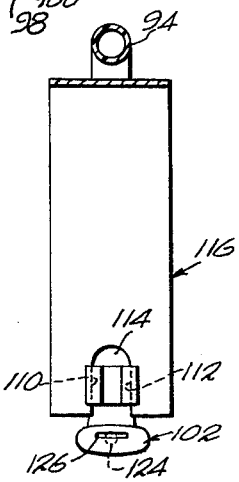
FIG. 7 is a sectional view taken along line 7—7 of FIG. 6.

Further referring to FIGS. 4 through 7, each spray head 102 is generally right angular in form and is provided with a generally round hole 124 of a predetermined diameter therethrough with the exception of the spray discharge end portion which is provided with a generally flat, outwardly fan-shaped aperture 126. This fan-shaped aperture 126 may be formed in a separate insert 128 as indicated in FIG. 6, for ease of manufacturing. The relative sizes of the round and fan-shaped holes are designed to produce the most desirable finely textured fan-shaped spray stream.

Figure 9:
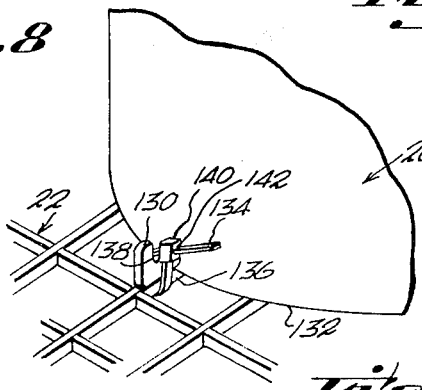
FIG. 9 is an enlarged fragmentary view illustrating a typical manner of attaching the air paddle valve assembly to the grill of the air conditioning unit.

With reference to FIG. 9, one means for attaching the valve housing 20 to a grill 22 is illustrated. At least two ears 130, one illustrated, are provided in an outwardly extended relation from the base portion 132 of housing 20. A commercially available strap 134 is engaged about a grill strip 136 and a notched portion 138 of ear 130. Strap 134 is of the type which includes small angular teeth along its length with a block portion 140 formed integrally at one end with a slot 142 to receive the strap in sliding engagement therethrough. A lock tooth is formed in the block to permit one way movement of the strap so that when two members are securely locked together the strap 134 cannot be removed.

While one preferred form of the invention has been illustrated and described, it is readily apparent that various changes and modifications can be made therein, within the scope of the invention, as defined in the appended claims.

What is claimed is:

1. An attachment comprising a water cooling system to be mechanically mounted exteriorly on an installed air cooled air conditioner without the requirement of electrical connection to the electrical system of the existing air conditioner and which air conditioner is of the type provided with:

condenser coil means having an upper zone and a first and a second main face, a fan means which, when the air conditioner is energized, directs a stream of air through the condenser coil means generally perpendicularly to the main faces, a frame for the fan and condenser coil means and which frame is configured to provide an air stream inlet and outlet with the inlet having an upper zone, and said frame including a first and second flow through grill work covering said inlet and outlet, said water cooling system comprising:

nozzle means to direct a spray of water into the frame through the upper zone of the inlet and onto the upper zone of the condenser coil means within the frame, water conduit means including means to connect to a pressurized water source and to said nozzle means, normally closed valve means in said conduit means between said source and nozzle means, and valve operating means to be mounted exteriorly of the frame and on the first grill work and at the air stream outlet, said valve operating means including a paddle with an air stream impact face to be oriented in generally parallel relation to the main faces of the frame, said valve operating means including tiltable means mounting said paddle to said valve operating means to accommodate swinging movement of the paddle from a normally valve means closed attitude to a valve means open attitude, said valve operating means being responsive to air stream forces when the air conditioner is energized to open said normally closed valve upon tilting movement from said valve closed attitude toward said valve open attitude to permit a flow of pressurized water from the source to the nozzle means, positioning, orienting and holding means included in said nozzle means to attach said nozzle means exteriorly of the frame and to direct water into the frame through the upper zone of the inlet and onto the upper zone of the condenser coil means to trickle down the condenser coil means from the upper zone, and attachment means to attach the valve operating means exteriorly of the frame and in the flow path and including orienting structure to orient said paddle face in generally parallel relation to the frame main faces when attached to an air conditioner.

2. The water cooling system as defined in claim 1 wherein said nozzle means comprises at least one spray head disposed exteriorly of the existing air conditioner housing and having a spray opening directed at the condenser coils within the existing air conditioner housing.

3. The water cooling system as defined in claim 2 including a plurality of said spray heads.

4. The water cooling system as defined in claim 3 wherein each of said spray heads is fixed relative to a first end of a spray tube which is connected at a second end to a water manifold, in fluid connection with said conduit means.

5. The water cooling system as defined in claim 4 including a mounting strip for each of said spray tubes and means to fix said spray tube to said mounting strip.

6. The water cooling system as defined in claim 5 including means to secure each of said mounting strips to the exterior of the air conditioner housing, each of said mounting strip and spray tube assemblies being appropriately configurated and comprising said nozzle means.

7. The water cooling system as defined in claim 6 wherein said means to secure comprises double-sided pressure sensitive adhesive tape.

8. The water cooling system as defined in claim 2 wherein said spray opening includes a main inner portion, generally round in cross section and being of a predetermined diameter, and a spray outlet end portion communicating with said round portion and being in a generally flat outwardly flared fan configuration.

9. The water cooling system as defined in claim 8 wherein said spray outlet end portion is formed in a separate insert fixed within an appropriate recess in an end portion of said spray head.

10. The water cooling system as defined in claim 1 including a water pressure regulator valve included in said water conduit means, including coupling means for engagement with a conventional faucet or garden hose, for example.

11. The water cooling system as defined in claim 1 wherein said valve operating means comprises an enlarged wind paddle pivoted relative to said valve means, said wind paddle being normally disposed in a first position when the air conditioner is not energized, and being movable to a second position, when the air conditioner is energized, and including connection means to said valve means to open said valve means when said wind paddle is in said second position.

12. The water cooling system as defined in claim 11 wherein said wind paddle is spring-loaded to said first position.

13. The water cooling system as defined in claim 11 wherein said valve and wind paddle are mounted in a housing, and including means to mount said housing to an existing exterior grill within the area of pasage of the exhaust stream.

* * * * *